US007821203B2

(12) United States Patent
Ohmura et al.

(10) Patent No.: US 7,821,203 B2
(45) Date of Patent: Oct. 26, 2010

(54) PHOTOMULTIPLIER

(75) Inventors: Takayuki Ohmura, Hamamatsu (JP); Suenori Kimura, Hamamatsu (JP); Masuo Ito, Hamamatsu (JP); Teruhiko Yamaguchi, Hamamatsu (JP)

(73) Assignee: Hamamatsu Photonics K.K., Hamamats-shi, Shizuoka (JP)

( * ) Notice: Subject to any disclaimer, the term of this patent is extended or adjusted under 35 U.S.C. 154(b) by 839 days.

(21) Appl. No.: 11/594,244

(22) Filed: Nov. 8, 2006

(65) Prior Publication Data

US 2008/0087831 A1 Apr. 17, 2008

Related U.S. Application Data

(60) Provisional application No. 60/851,751, filed on Oct. 16, 2006.

(51) Int. Cl.
*H01J 43/18* (2006.01)

(52) U.S. Cl. ..... 313/533; 313/532

(58) Field of Classification Search ..... 313/532–536
See application file for complete search history.

(56) References Cited

U.S. PATENT DOCUMENTS

| | | | |
|---|---|---|---|
| 2,945,144 | A | 7/1960 | Schmidt et al. |
| 3,849,644 | A | 11/1974 | Ibaugh |
| 4,415,832 | A | 11/1983 | Faulkner et al. |
| 4,456,852 | A | 6/1984 | Faulkner et al. |
| 4,881,008 | A | 11/1989 | Kyushima et al. |
| 5,077,504 | A | 12/1991 | Helvy |

(Continued)

FOREIGN PATENT DOCUMENTS

| | | |
|---|---|---|
| JP | 57-194445 | 11/1982 |

(Continued)

OTHER PUBLICATIONS

Hidehiro Kume et al., "Photomultiplier Tubes for $BaF_2$/BGO Crystal Scintillators", IEEE Transaction on Nuclear Science, Feb. 1986, pp. 364-369, vol. 33, No. 1.

(Continued)

*Primary Examiner*—Nimeshkumar D Patel
*Assistant Examiner*—Christopher M Raabe
(74) *Attorney, Agent, or Firm*—Drinker Biddle & Reath LLP

(57) ABSTRACT

The present invention relates to a photomultiplier that realizes significant improvement of response time properties with a structure enabling mass production. The photomultiplier comprises a sealed container, and the sealed container includes a hollow body section, extending along a tube axis, and a faceplate. The faceplate has a light incidence surface and a light emission surface on which a photocathode is formed. In particular, the light emission surface is constituted by a flat region, and a curved-surface processed region that is positioned at a periphery of the flat region and that includes edges of the light emission surface. A surface shape of the peripheral region of the light emission surface of the faceplate is thus intentionally changed in order to adjust the angles of emission of photoelectrons from the photocathode positioned at the peripheral region. Thus, the spread of transit times of photoelectrons propagating from the photocathode to a first dynode is thus reduced effectively and made not to depend on the emission positions of the photoelectrons.

12 Claims, 14 Drawing Sheets

U.S. PATENT DOCUMENTS

| | | | | |
|---|---|---|---|---|
| 5,124,551 | A | | 6/1992 | Urakami et al. |
| 5,416,382 | A | | 5/1995 | L'Hermite |
| 5,438,191 | A | | 8/1995 | Kimura et al. |
| 5,532,551 | A | | 7/1996 | Kyushima et al. |
| 5,578,891 | A | | 11/1996 | Sakai et al. |
| 5,581,158 | A | | 12/1996 | Quazi |
| 5,598,060 | A | | 1/1997 | L'Hermite |
| 5,689,152 | A | | 11/1997 | Boutot et al. |
| 5,864,207 | A | | 1/1999 | Kume et al. |
| 5,917,282 | A | * | 6/1999 | Suyama et al. ..... 313/544 |
| 5,936,348 | A | | 8/1999 | Shimoi et al. |
| 6,927,538 | B2 | | 8/2005 | Ishizu et al. |
| 7,064,485 | B2 | | 6/2006 | Kimura et al. |
| 7,115,854 | B1 | | 10/2006 | Kato et al. |
| 2003/0146697 | A1 | | 8/2003 | Ishizu et al. |
| 2004/0251417 | A1 | | 12/2004 | Yamaguchi et al. |
| 2005/0212421 | A1 | | 9/2005 | Kimura et al. |
| 2008/0088234 | A1 | | 4/2008 | Ohmura et al. |

FOREIGN PATENT DOCUMENTS

| | | |
|---|---|---|
| WO | 2005/091332 | 9/2005 |
| WO | 2005/091333 | 9/2005 |

OTHER PUBLICATIONS

T. Yamashita et al., "New Dual Rectangular Photomultiplier Tube for Positron Ct." IEEE Catalog No. 82CH1751-7, International Workshop on Physics and Engineering in Medical Imaging, Mar. 15-18, 1982, pp. 209-211, Pacific Grove, California.

* cited by examiner

PHOTOMULTIPLIER

CROSS-REFERENCE TO RELATED APPLICATION

This application claims priority to U.S. Provisional Application Ser. No. 60/851,751 filed on Oct. 16, 2006 by the same Applicant, which is hereby incorporated by reference in its entirety.

BACKGROUND OF THE INVENTION

1. Field of the Invention

The present invention relates to a photomultiplier, which, in response to incidence of photoelectrons, can perform cascade multiplication of secondary electrons by successive emission of the secondary electrons in multiple stages.

2. Related Background Art

In recent years, development of TOF-PET (Time-of-Flight PET) as a next-generation PET (Positron Emission Tomography) device is being pursued actively in the field of nuclear medicine. In a TOF-PET device, because two gamma rays, emitted from a radioactive isotope administered into a body, are measured simultaneously, a large number of photomultipliers with excellent, high-speed response properties are used as measuring devices that are disposed so as to surround an object.

In particular, in order to realize high-speed response properties of higher stability, multichannel photomultipliers, in which a plurality of electron multiplier channels are prepared and electron multiplications are performed in parallel at the plurality of electron multiplier channels, are coming to be applied to next-generation PETs, such as that mentioned above, in an increasing number of cases. For example, a multichannel photomultiplier described in International Patent Publication No. WO2005/091332 has a structure, in which a single faceplate is partitioned into a plurality of light incidence regions (each being a photocathode to which a single electron multiplier channel is allocated) and a plurality of electron multiplier sections (each arranged from a dynode unit, made up of a plurality of stages of dynodes, and an anode), prepared as electron multiplier channels that are allocated to the plurality of light incidence regions, are sealed inside a single glass tube. A photomultiplier with the structure, such that a plurality of photomultipliers are contained inside a single glass tube, is generally called a multichannel photomultiplier.

As described above, a multichannel photomultiplier thus has a structure such that a function of a single-channel photomultiplier, with which photoelectrons emitted from a photocathode disposed on a faceplate are electron multiplied by a single electron multiplier section to obtain an anode output, is shared by the plurality of electron multiplier channels. For example, in a multichannel photomultiplier, with which four light incidence regions (photocathodes for electron multiplier channels) are two-dimensionally arranged, because for one electron multiplier channel, a photoelectron emission region (effective region of the corresponding photocathode) is made ¼ or less of the faceplate, electron transit time differences among the respective electron multiplier channels can be improved readily. Consequently, as compared with the electron transit time differences within the entirety of a single channel photomultiplier, a significant improvement in electron transit time differences can be anticipated with the entirety of a multichannel photomultiplier.

SUMMARY OF THE INVENTION

The present inventors have examined the above prior art, and as a result, have discovered the following problems. That is, in the conventional multichannel photomultiplier, because electron multiplications are performed by electron multiplier channels that are allocated in accordance with release positions of photoelectrons from the photocathode, the positions of the respective electrodes are designed optimally so as to reduce electron transit time differences according to each electron multiplier channel. In this manner, by such improvement of the electron transit time differences in each electron multiplier channel, improvements are made in the electron transit time differences of the whole multichannel photomultiplier and consequently, the high-speed response properties of the whole multichannel photomultiplier are improved.

However, in such a multichannel photomultiplier, no improvements had been made in regard to the spread of the average electron transit time differences among the electron multiplier channels. Also, in regard to a light emission surface (surface positioned in the interior of the sealed container) of the faceplate on which the photocathode is formed, the shape of the light emission surface is distorted in a peripheral region that surrounds a central region, which includes the tube axis of the sealed container, and especially at boundary portions (edges of the light emission surface) at which the light emission surface and an inner wall of the tube body intersect. The equipotential lines between the photocathode and the dynodes or between the photocathode and the focusing electrode are thereby distorted, and even within a single channel, photoelectrons that fall astray may be generated depending on the photoelectron emission position. The presence of such stray photoelectrons cannot be ignored for further improvement of high-response properties.

Furthermore, because a large number of photomultipliers are required for the manufacture of a TOF-PET device, employment of a structure that is more suited for mass production is desired with photomultipliers that are applied to a TOF-PET device, etc.

The present invention has been developed to eliminate the problems described above, and an object thereof is to realize reduction of emission-position-dependent photoelectron transit time differences of photoelectrons emitted from a photocathode by a structure more suited for mass production to provide a photomultiplier that is significantly improved as a whole in such response time properties as TTS (Transit Time Spread) and CTTD (Cathode Transit Time Difference).

Presently, PET devices added with a TOF (Time-of-Flight) function are developed. In photomultipliers used in such a TOF-PET device, the CRT (Coincidence Resolving Time) response properties are also important. Conventional photomultipliers do not meet the CRT response properties requirements of TOF-PET devices. Thus, in the present invention, because a conventional PET device is used as a basis, a currently used bulb outer diameter is maintained, and trajectory design is carried out to enable CRT measurements that meet the requirements of a TOF-PET device. Specifically, improvement of the TTS, which is correlated with the CRT response properties, is aimed at, and trajectory design is carried out to improve both the TTS across an entire faceplate and the TTS in respective incidence regions.

A photomultiplier according to the present invention comprises a sealed container that is provided, at a bottom portion thereof, with a pipe for reducing the pressure of the interior of the container to a predetermined degree of vacuum, and a photocathode and an electron multiplier section that are provided inside the sealed container. The sealed container is constituted by a faceplate, a tube body (bulb), having the faceplate fusion-joined to one end and extending along a predetermined tube axis, and a stem fusion-joined to the other end of the tube body and constituting a bottom portion of the sealed container. The faceplate has a light incidence surface and a light emission surface that opposes the light incidence surface, and the photocathode is formed on the light emission surface positioned at the inner side of the sealed container. The sealed container may have an envelope portion, with which the faceplate and the tube body are formed integrally, and in this case, the sealed container is obtained by fusion-joining the stem to an opening of the envelope portion.

An installation position of the electron multiplier section in the tube axis direction inside the sealed container is defined by lead pins that extend into the sealed container from the stem. The electron multiplier section also includes a focusing electrode unit, for modifying trajectories of photoelectrons emitted into the sealed container from the photocathode, and a dynode unit, for cascade multiplication of the photoelectrons.

In the photomultiplier according to the present invention, the dynode unit has a pair of insulating supporting members that hold the focusing electrode unit and clampingly hold at least one set of electrodes that cascade-multiply the photoelectrons from the photocathode. In particular, in a case where two or more electrode sets are held by the pair of insulating supporting members, these electrode sets are positioned across the tube axis. One or more electron multiplier channels may be formed by each electrode set, and an anode is prepared according to each electron multiplier channel that is formed.

In particular, the photomultiplier according to the present invention adjusts the emission angles of photoelectrons emitted from the photocathode, by changing a surface shape of a peripheral region of the light emission surface of the faceplate on which the photocathode is formed. That is, the photomultiplier has a structure, with which the shape of the peripheral region of the light emission surface of the faceplate is changed to reduce the spread of transit times of photoelectrons propagating from the photocathode to a first dynode such that the transit times do not depend on the emission positions of the photoelectrons. Specifically, the light emission surface of the faceplate on which the photocathode is formed is constituted by a flat region, positioned at the middle of the light emission surface including the tube axis, and a curved-surface processed region, positioned at a periphery of the flat region and including edges of the light emission surface.

In order to realize the above surface formation, the light emission surface of the faceplate is surface-processed such that, in a cross section of the photomultiplier which includes the tube axis and which crosses two electrode sets arranged so as to sandwich the tube axis (in a case where there is only one electrode set, the cross section that includes the tube axis and that crosses just one electrode set), a curve that defines the curved-surface processed region is positioned at the electron multiplier section side of an intersection $P_o$ of a first straight line on the flat region and a second straight line that is parallel to an inner wall surface of the tube body and passes through an edge of the light emission surface (see FIG. 12).

The light emission surface of the faceplate is also surface-processed such that, in the cross section of the photomultiplier which includes the tube axis and which crosses two electrode sets arranged so as to sandwich the tube axis, when $P_E$ is an intersection (first intersection) of the first straight line on the flat region and the curve that defines the curved-surface processed region and $P_S$ is an intersection (second intersection) of the second straight line that is parallel to the inner wall surface of the tube body and passes through the edge of the light emission surface and the curve that defines the curved-surface processed region, a distance $\alpha_1$ between the intersection $P_o$ of the first and second straight lines and the intersection $P_S$ is shorter than a distance $\alpha_2$ between the intersection $P_o$ and the intersection $P_E$ (see FIG. 12). Here, the intersection $P_E$ of the first straight line and the curve that defines the curved-surface processed region corresponds to a boundary between the flat region and the curved-surface processed region on the light emission surface. The intersection $P_s$ of the second straight line and the curve that defines the curved-surface processed region corresponds to an edge of an effective cathode area.

The light emission surface of the faceplate may be surface-processed such that, in the cross section of the photomultiplier which includes the tube axis and which crosses two electrode sets arranged so as to sandwich the tube axis, a central point O of a radius of curvature R that defines a curve corresponding to the curved-surface processed region is positioned closer to the inner wall surface of the tube body than the tube axis and closer to the anode than the focusing electrode (see FIG. 12).

In the photomultiplier according to the present invention, the light emission surface of the faceplate may be surface-processed such that an area ratio of the flat region with respect to the effective cathode area (that includes the flat region and the curved-surface processed region) is 30% or more but 70% or less.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DETAILED DESCRIPTION OF THE PREFERRED EMBODIMENTS

In the following, embodiments of a photomultiplier according to the present invention will be explained in detail with reference to FIGS. 1, 2A-2B, 3-4, 5A-5B, 6, 7A-11B, 12, and 13A-14B. In the explanation of the drawings, constituents identical to each other will be referred to with numerals identical to each other without repeating their overlapping descriptions.

Figure 1:
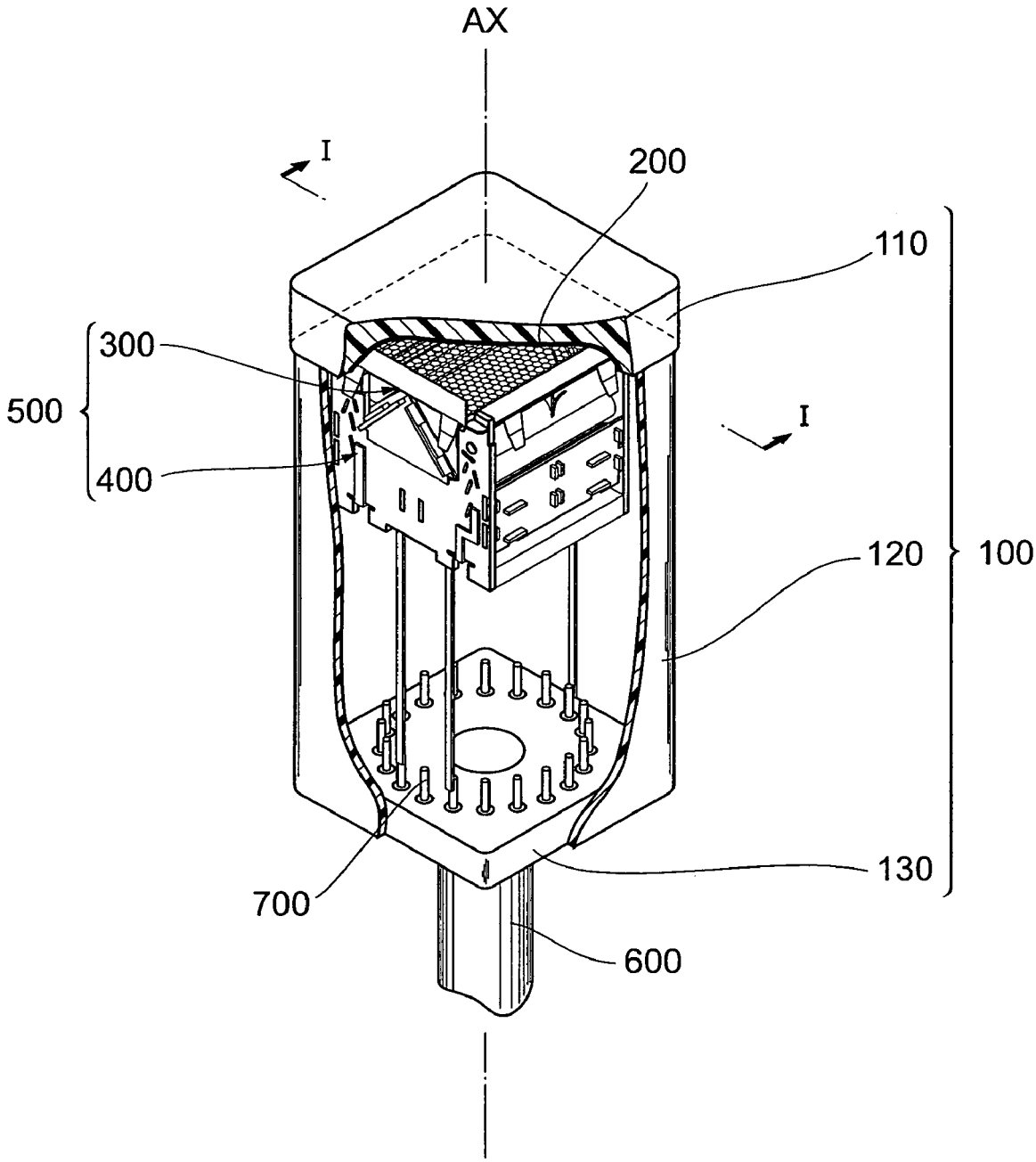
FIG. 1 is a partially broken-away view of a general configuration of an embodiment of a photomultiplier according to the present invention.
Figure 2A:
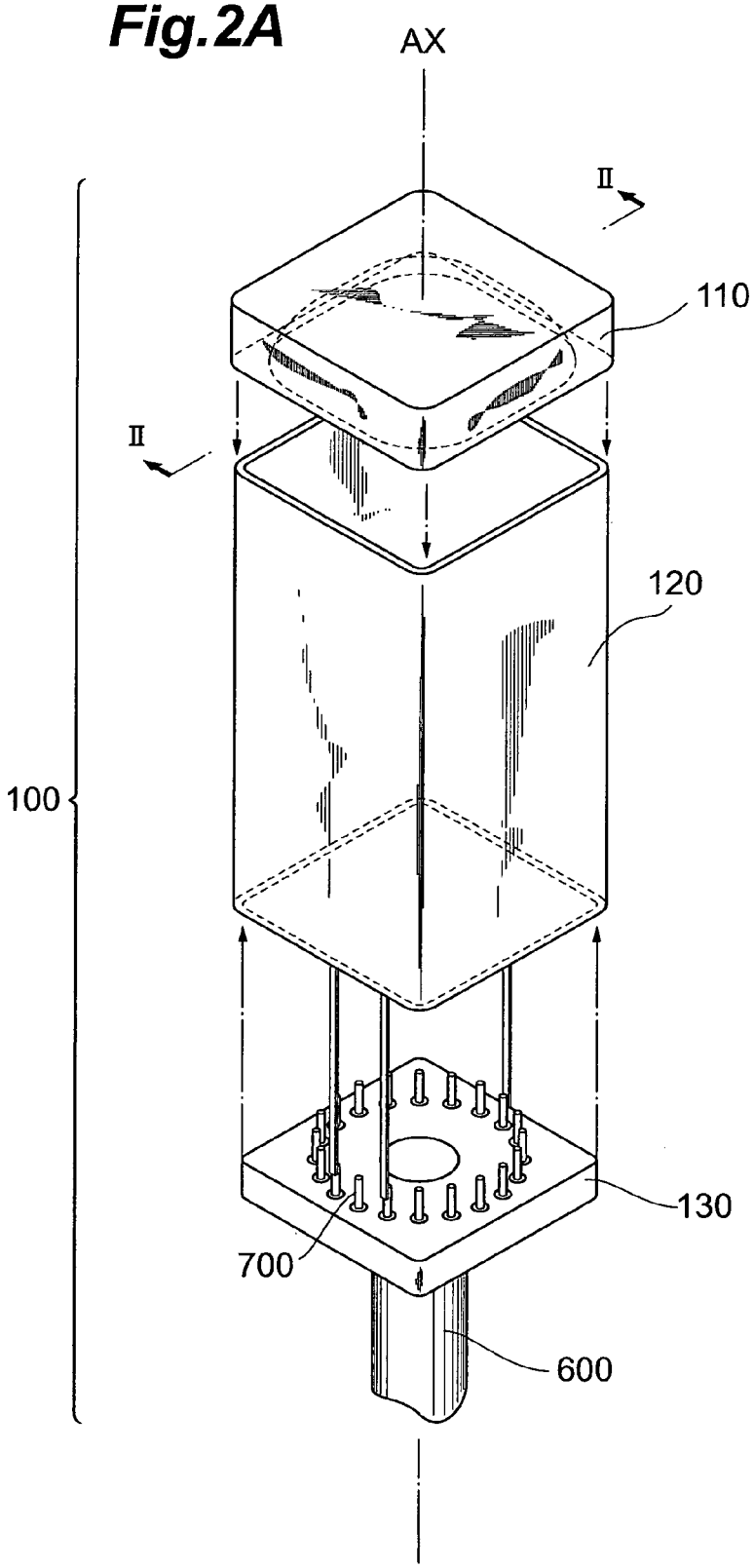
FIGS. 2A and 2B are an assembly process diagram and a cross sectional view, respectively, for explaining a structure of a sealed container in the photomultiplier according to the present invention.
Figure 2B:
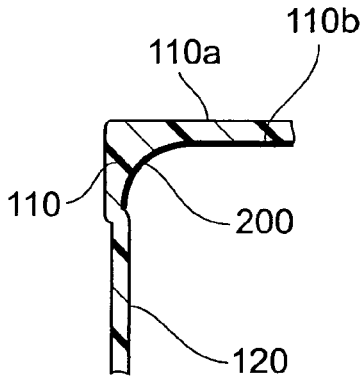

FIG. 1 is a partially broken-away view of a general arrangement of an embodiment of a photomultiplier according to the present invention. FIGS. 2A and 2B are an assembly process diagram and a sectional view, respectively, for explaining a structure of a sealed container in the photomultiplier according to the present invention.

As shown in FIG. 1, the photomultiplier according to the present invention has a sealed container 100, with a pipe 600, which is used to depressurize the interior to a predetermined degree of vacuum (and the interior of which is filled after vacuum drawing), provided at a bottom portion, and has a photocathode 200 and an electron multiplier section 500 provided inside the sealed container 100.

As shown in FIG. 2A, the sealed container 100 is constituted by a faceplate 110, a tube body (bulb) 120 having the faceplate 110 that is fusion joined to one end and that extends along a predetermined tube axis AX, and a stem 130 that is fusion-joined to the other end of the tube body 120 and that constitutes a bottom portion of the sealed container 100 provided with the pipe 600. FIG. 2B is a cross sectional view of the sealed container 100 taken on line I-I of FIG. 2A and shows, in particular, a portion at which the faceplate 110 is fusion-joined to the one end of the tube body 120. The faceplate 110 has a light incidence surface 110*a* and a light emission surface 110*b* that opposes the light incidence surface 110*a*, and the photocathode 200 is formed on the light emission surface 110*b* positioned at the inner side of the sealed container 100. The tube body 120 is a hollow member that is centered about the tube axis AX and extends along the tube axis AX. The faceplate 110 is fusion-joined to one end of this hollow member and the stem 130 is fusion-joined to the other end. The stem 130 is provided with a penetrating hole that extends along the tube axis AX and puts the interior of the sealed container 100 in communication with the exterior. Lead pins 700 are arranged so as to surround this penetrating hole. At the position at which the penetrating hole is provided, the pipe 600, for evacuating the air inside the sealed container 100, is attached to the stem 130.

An installation position of the electron multiplier section 500 in the tube axis AX direction inside the sealed container 100 is defined by the lead pins 700 that extend into the sealed container 100 from the stem 130. The electron multiplier section 500 also comprises a focusing electrode unit 300 for modifying trajectories of photoelectrons emitted into the sealed container 100 from the photocathode 200, and a dynode unit 400 for cascade multiplication of the photoelectrons.

In the following explanation, a multichannel photomultiplier, with which four electron multiplier channels CH1 to CH4 are constituted by two sets of electrodes (dynodes) arranged so as to sandwich the tube axis AX, shall be explained as an embodiment of the photomultiplier according to the present invention.

Figure 3:
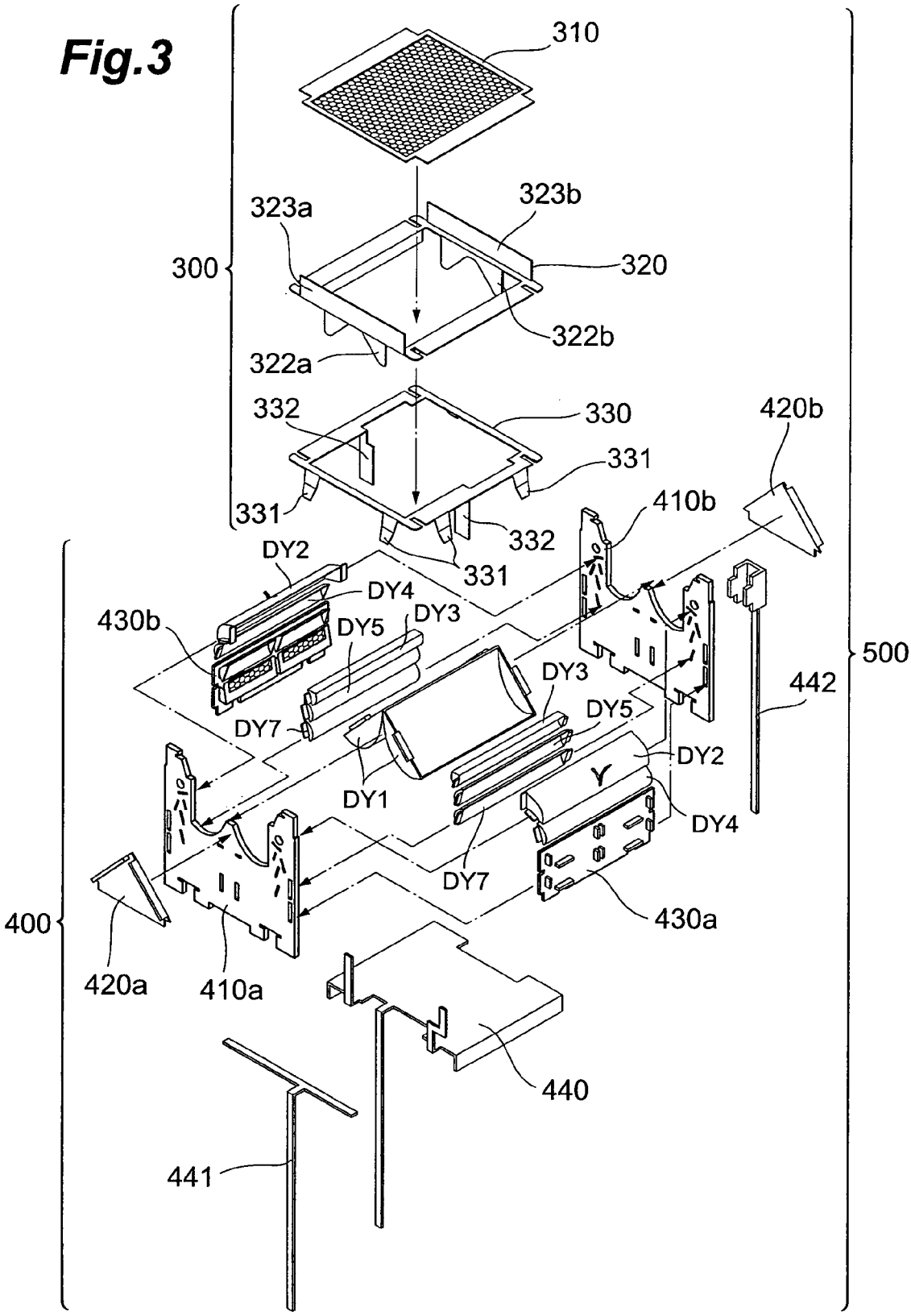
FIG. 3 is an assembly process diagram for explaining a structure of an electron multiplier section in the photomultiplier according to the present invention.

FIG. 3 is an assembly process diagram for explaining a structure of the electron multiplier section 500 in the photomultiplier according to the present invention. In FIG. 3, the electron multiplier section 500 has the focusing electrode unit 300 and the dynode unit 400.

The focusing electrode unit 300 is constituted by laminating a mesh electrode 310, a shield member 320, and a spring electrode 330. The mesh electrode 310 has a metal frame which is provided with an opening that allows photoelectrons from the photocathode 200 to pass through. The opening defined by the frame portion of the mesh electrode 310 is covered by a metal mesh that is provided with a plurality of openings. The shield member 320 has a metal frame provided with the opening that allows photoelectrons from the photocathode 200 to pass through. The frame portion that defines the opening of the shield member 320 is provided with shield plates 323*a*, 323*b* that extend toward the photocathode 200 and with shield plates 322*a*, 322*b* that extend toward the stem 130. The shield plates 323*a*, 323*b* respectively enable control of positions of incidence of photoelectrons onto first dynodes DY1 and function to adjust an electric field lens formed between the photocathode 200 and the focusing electrode unit 300 to improve the CTTD (that is, the TTS) response properties. The shield plates 322*a*, 322*b* are respectively positioned so as to close a space that is open at opposite ends of the first dynodes DY1. The shield plates 322*a*, 322*b* are set to a potential that is higher than that of the first dynodes DY1 (and equal to that of second dynodes DY2) and function to strengthen the electric field between the first dynodes DY1 and the second dynodes DY2. The efficiency of incidence onto the second dynodes DY2 of secondary electrons that propagate from the first dynodes DY1 to the second dynodes DY2 can thereby be improved, and the spread of transit times of secondary electrons between the first dynodes DY1 and the second dynodes DY2 is reduced. The spring electrode 330 has a metal frame provided with an opening that allows photoelectrons from the photocathode 200 to pass through. The frame portion of the spring electrode 330 is provided with metal springs 331 (electrode portions), which, by being pressed against an inner wall of the sealed container 100, maintain the entirety of the electron multiplier section 500, on which the focusing electrode unit 300 is mounted, at a predetermined position inside the sealed container 100. The frame portion of the spring electrode 330 is also provided with partitioning plates 332 that partition the second dynodes DY2, positioned immediately below, into two in a longitudinal direction of the second dynodes DY2. The partitioning plates 332 are set to the same potential as the second dynodes DY2 and function to effectively reduce the crosstalk between mutually adjacent electron multiplier channels that are formed from an electrode set of one series.

On the other hand, the dynode unit 400 has a pair of insulating supporting members (a first insulating supporting member 410*a* and a second insulating supporting member 410*b*) that hold the focusing electrode unit 300 of the above-described structure and clampingly hold at least two electrode sets that cascade-multiply the photoelectrons from the photocathode 200. Specifically, the first and second insulating supporting members 410*a*, 410*b* integrally clamp the pair of first dynodes DY1, the pair of second dynodes DY2, a pair of third dynodes DY3, a pair of fourth dynodes DY4, a pair of fifth dynodes DY5, a pair of seventh dynodes DY7, and a pair of gain control units 430*a*, 430*b*, with the dynodes or units of each pair being disposed along the tube axis AX and across the tube axis AX with respect to each other. Metal pins 441, 442 for setting the respective electrodes at predetermined potentials are mounted onto the first and second insulating supporting members 410*a*, 410*b*. The first and second insulating supporting members 410*a*, 410*b* clampingly hold, in addition to the respective electrodes, a bottom metal plate 440 that is set to a ground potential (0V).

In a state of being installed at upper portions of the first and second insulating supporting members 410*a*, 410*b*, the pair of first dynodes DY1 have metal fixing members 420*a*, 420*b* welded to both ends. Each of the pair of gain control units 430*a*, 430*b* has an insulating base plate 431 and onto this insulating base plate 431 are mounted a corresponding sixth dynode DY6, anode 432, and eighth dynode DY8. Here, each sixth dynode DY6 is constituted by two electrodes that are mounted on the insulating base plate 431 in an electrically separated state. Each anode 432 is constituted by two electrodes that are mounted on the insulating base plate 431 in an electrically separated state. Each eighth dynode DY8 is a common electrode for the two electrodes that constitute the sixth dynode DY6 and the two electrodes that constitute the anode 432.

As described above, each of the gain control units 430*a*, 430*b* belongs to one of the two electrode sets arranged so as to sandwich the tube axis AX. Thus, by these gain control units 430*a*, 430*b* being arranged together with the partitioning plates 332, the four-channel photomultiplier, with which two electron multiplier channels are formed by each electrode set, is arranged. The sixth dynode DY6 in each of the gain control units 430*a*, 430*b* is also constituted by two electrodes, and thus, for the photomultiplier as a whole, four electrodes are allocated as the sixth dynodes DY6 respectively to the electron multiplier channels. By individually adjusting the potentials of the electrodes allocated as the sixth dynodes DY6 to the respective electron multiplier channels, each electron multiplier channel can be adjusted in gain independent of the others.

Figure 4:
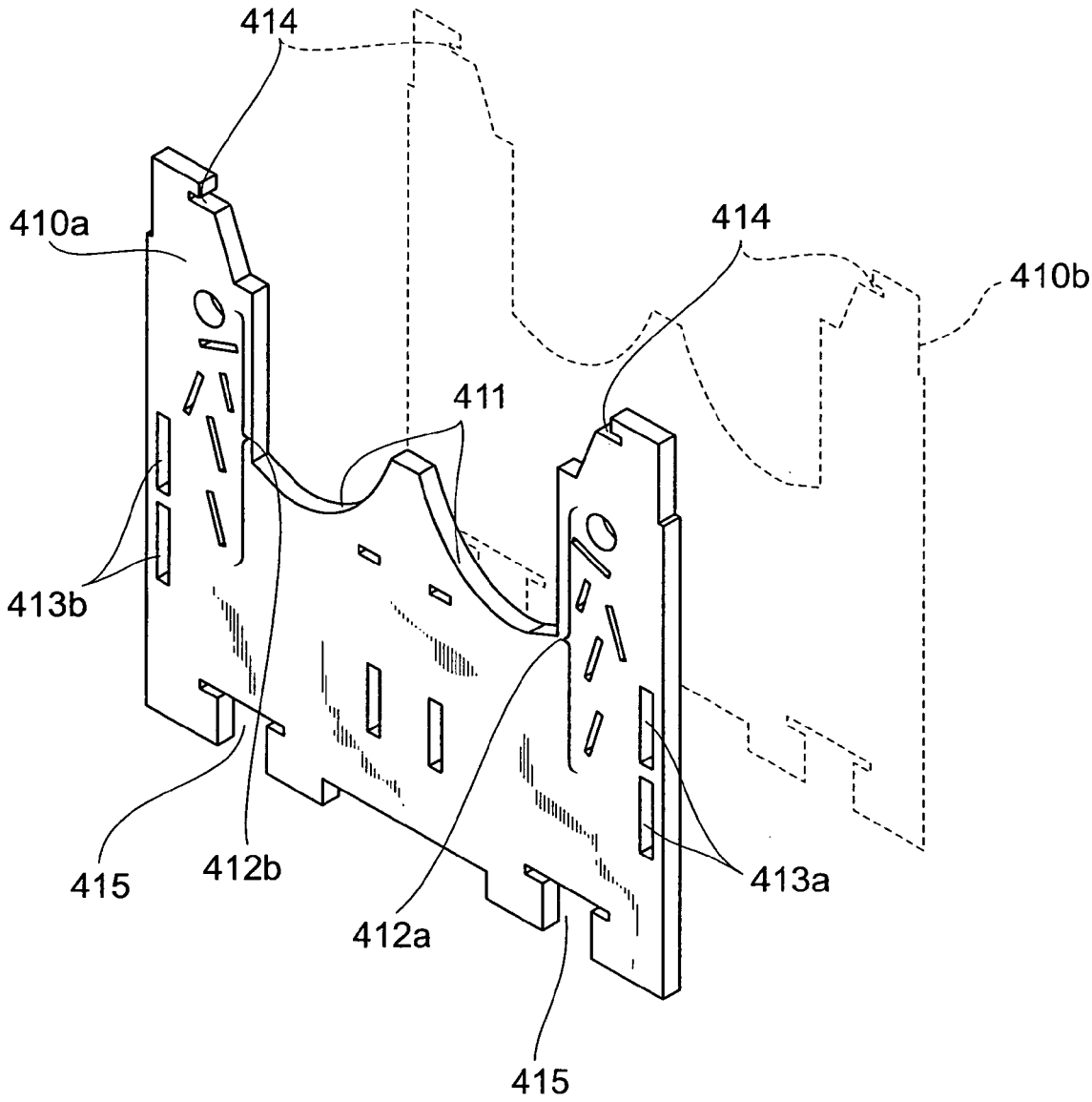
FIG. 4 is a diagram for explaining a structure of a pair of insulating supporting members that constitute a portion of the electron multiplier section shown in FIG. 3.

FIG. 4 is a diagram for explaining a structure of the pair of insulating supporting members 410*a*, 410*b* that constitute a portion of the electron multiplier section shown in FIG. 3. Because the first insulating supporting member 410*a* and the second insulating supporting member 410*b* are identical in shape, just the first insulating supporting member 410*a* will be explained below and explanation of the second insulating supporting member 410*b* will be omitted.

The first insulating supporting member 410*a* comprises: a main body that holds the first electrode set of the first to fifth dynodes DY1 to DY5, the seventh dynode DY7 and the gain control unit 430*a*, and the second electrode set of the first to fifth dynodes DY1 to DY5, the seventh dynode DY7 and the gain control unit 430*b*; and protruding portions that extend from the main body toward the photocathode 200.

The main body of the first insulating supporting member 410*a* is provided with fixing slits 412*a*, 413*a* for fixing the first electrode set, and fixing slits 412*b*, 413*b* for fixing the second electrode set (the same fixing slits are provided in the main body of the second insulating supporting member 410*b* as well).

Figure 5A:
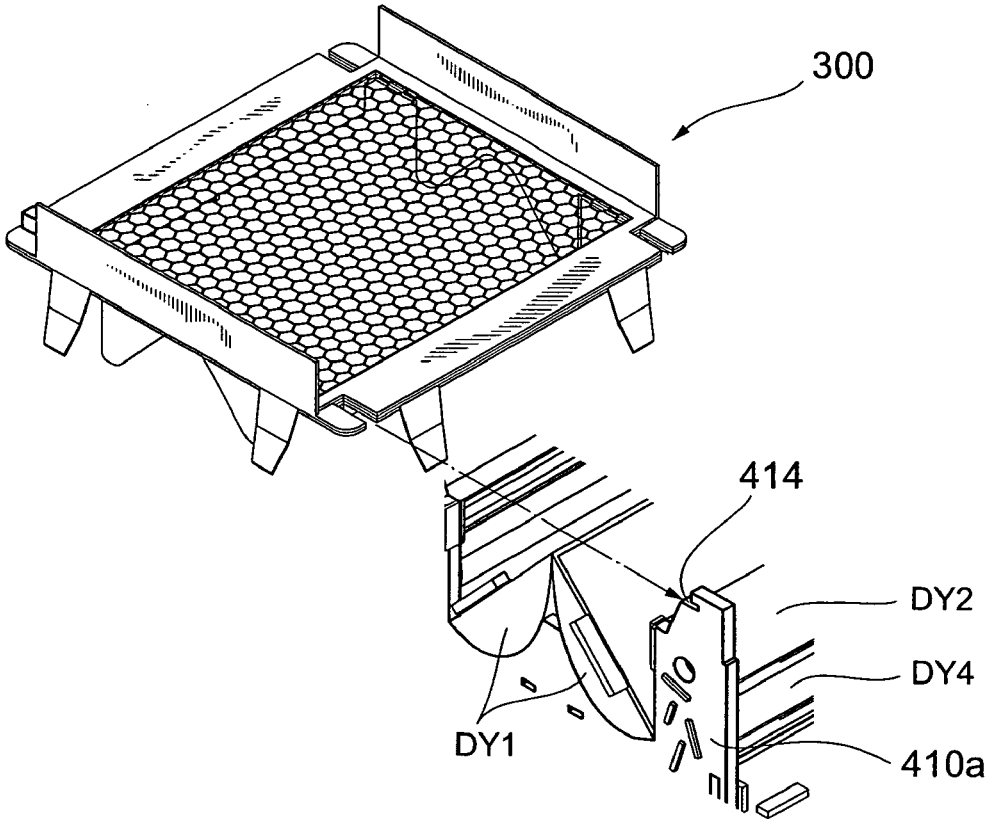
FIG. 5A is a diagram for explaining a structure that joins a focusing electrode unit and the pair of insulating supporting members.
Figure 5B:
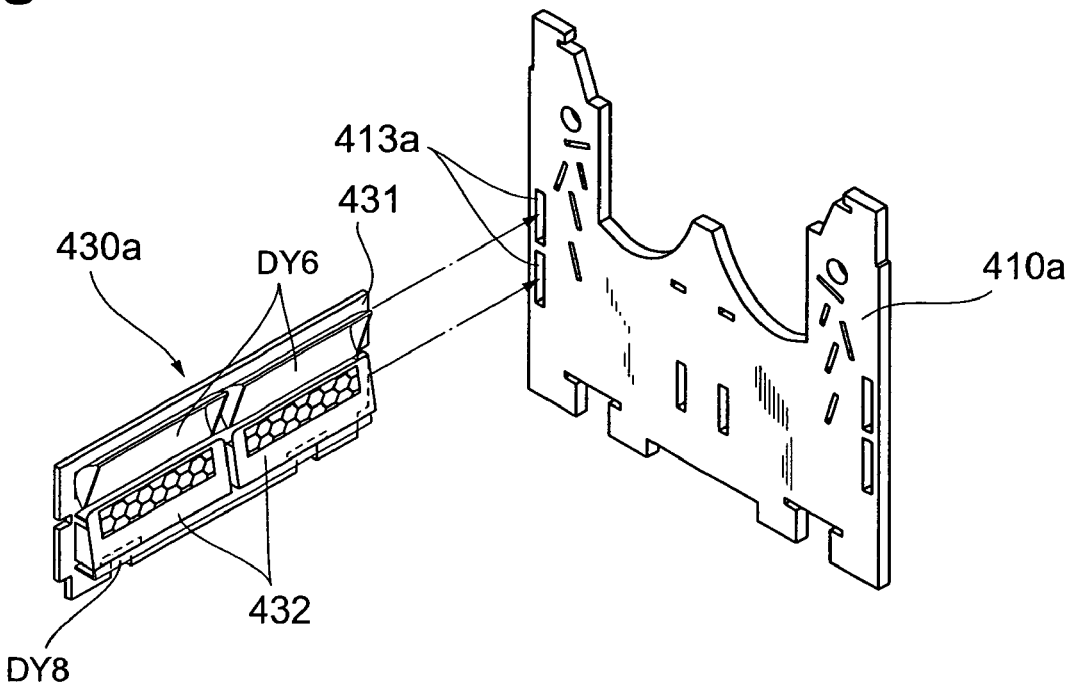
FIG. 5B is a diagram for explaining a structure that joins gain control units and the pair of insulating supporting members.

Of the first electrode set, one of fixing tabs provided at opposite ends of the second dynode DY2, one of fixing tabs provided at opposite ends of the third dynode DY3, one of fixing tabs provided at opposite ends of the fourth dynode DY4, one of fixing tabs provided at opposite ends of the fifth dynode DY5, and one of fixing tabs provided at opposite ends of the seventh dynode DY7 are inserted into the fixing slits 412*a* and these electrode members are thereby integrally clamped by the first and second insulating supporting members 410*a*, 410*b*. Also, as shown in FIG. 5B, fixing tabs of one end among fixing tabs provided at opposite ends of the gain control unit 430*a* belonging to the electrode set of the first series are inserted in the fixing slits 413*a*. Of the second electrode set, one of fixing tabs provided at opposite ends of the second dynode DY2, one of fixing tabs provided at opposite ends of the third dynode DY3, one of fixing tabs provided at opposite ends of the fourth dynode DY4, one of fixing tabs provided at opposite ends of the fifth dynode DY5, and one of fixing tabs provided at opposite ends of the seventh dynode DY7 are inserted into the fixing slits 412*b* and these electrode members are thereby integrally clamped by the first and second insulating supporting members 410*a*, 410*b*. Also, fixing tabs of one end among fixing tabs provided at opposite ends of the gain control unit 430*b* belonging to the electrode set of the second series are inserted in the fixing slits 413*b*.

Furthermore, notches 415 for clampingly holding a bottom metal plate 440 is provided at a bottom portion of the first insulating supporting member 410*a* (the same holds for the second insulating supporting member 410*b*). Also, pedestal portions 411, on which the first dynodes DY1 are mounted, are formed at portions sandwiched by the protruding portions of the first insulating supporting member 410*a*, and a notch 414 for holding the focusing electrode unit 300 is formed in each of the protruding portions (the same holds for the second insulating supporting member 410*b*). Specifically, as shown in FIG. 5A, notches formed in the focusing electrode unit 300 are inserted in the notches 414 respectively provided in the protruding portions of the first insulating supporting member 410*a*, and the focusing electrode unit 300 is thereby clampingly held integrally by the first and second insulating supporting members 410*a*, 410*b*. FIG. 5A is a diagram for explaining the structure that joins the focusing electrode unit 300 and the pair of insulating supporting members 410*a*, 410*b*, and FIG. 5B is a diagram for explaining the structure that joins the gain control units 430*a*, 430*b* and the pair of insulating supporting members 410*a*, 410*b*.

Figure 6:
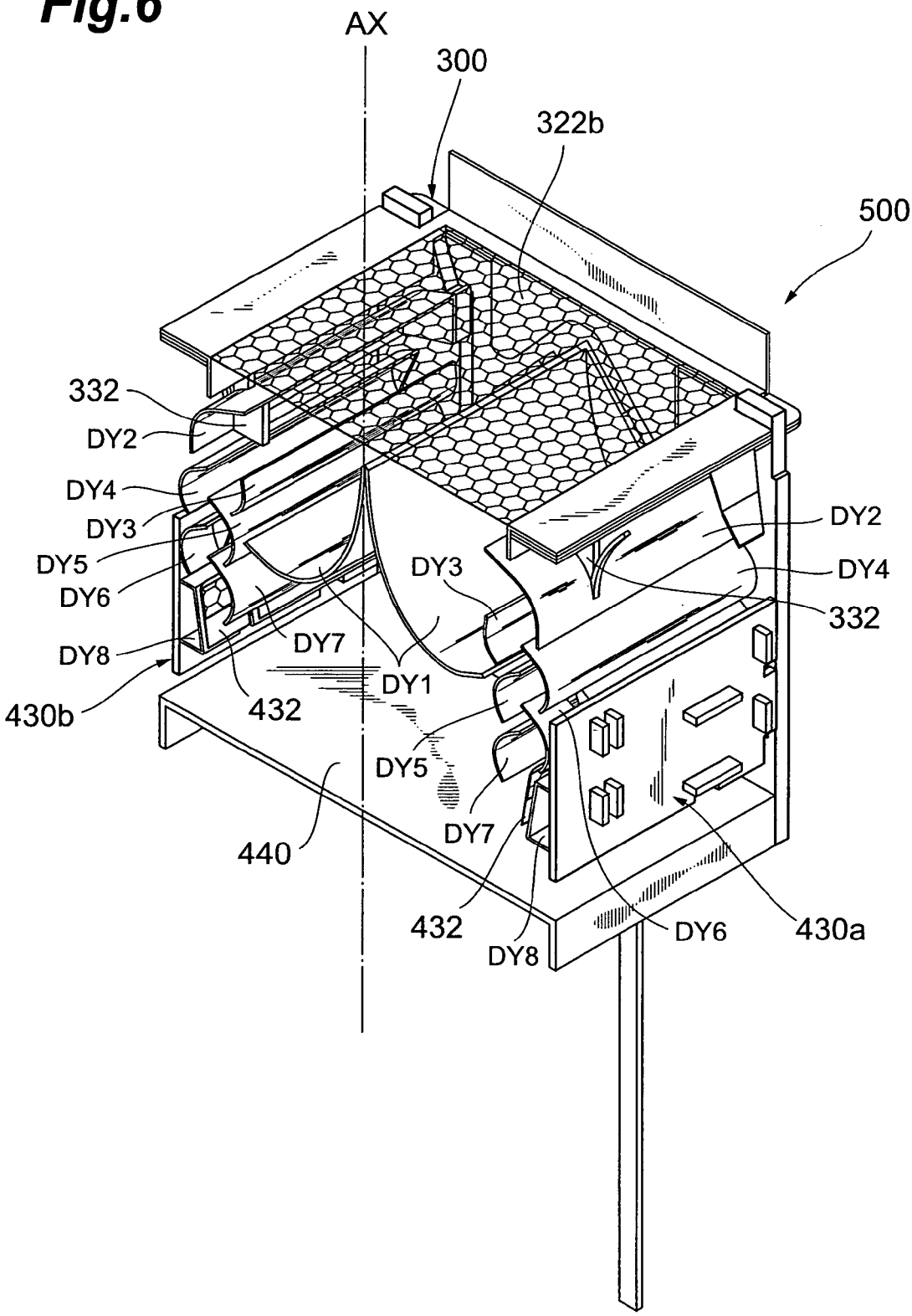
FIG. 6 is a perspective view for explaining a cross sectional structure of the electron multiplier section taken on line I-I shown in FIG. 1.

FIG. 6 is a perspective view for explaining a cross sectional structure of the electron multiplier section taken on line I-I shown in FIG. 1. As shown in FIG. 6, the electron multiplier section 500 has two electrode sets arranged so as to sandwich the tube axis AX. In each of these two electrode sets, mutually adjacent electron multiplier channels that can be adjusted in gain independently of each other are arranged by the corresponding partitioning plate 332, provided in the spring electrode 330 that constitutes a portion of the focusing electrode unit 300, and by the disposition of the corresponding gain control unit 430*a* or 430*b*. In the electron multiplier section 500 shown in FIG. 6, four electron multiplier channels are thus formed in correspondence to photoelectron emission positions of the photocathode 200.

In the one electrode set (first electrode set), among the two electrode sets arranged so as to sandwich the tube axis AX, to which the gain control unit 430*a* belongs, a secondary electron emitting surface is formed on each of the first dynode DY1 to the eighth dynode DY8. The set potential of each of the first dynode DY1 to the eighth dynode DY8 is increased in the order of the first dynode DY1 to the eighth dynode DY8 to guide the secondary electrons successively to the dynode of the next stage. The potential of the anode 432 is higher than the potential of the eighth dynode DY8. For example, the photocathode 200 is set to −1000V, the first dynode DY1 is set to −800V, the second dynode DY2 is set to −700V, the third dynode DY3 is set to −600V, the fourth dynode DY4 is set to −500V, the fifth dynode DY5 is set to −400V, the sixth dynode DY6 is set to −300V (made variable to enable gain adjustment), the seventh dynode DY7 is set to −200V, the eighth dynode DY8 is set to −100V, and the anode 432 is set to the ground potential (0V). The focusing electrode unit 300, with the partitioning plates 332, is set to the same potential as the second dynodes DY2.

The photoelectrons emitted from the photocathode 200 arrive at the first dynode DY1 after passing through the mesh openings of the focusing electrode unit 300 that is set to the same potential as the second dynode DY2. The shield plate 322*b*, set to the same potential as the second dynode DY2, is disposed at a space that is opened in the longitudinal direction of the first dynode DY1, and by this, the electric field between the first dynode DY1 and the second dynode DY2 is strengthened, the efficiency of incidence onto the second dynode DY2 of the secondary electrons, propagating from the first dynode DY1 to the second dynode DY2, can be improved, and the spread of transit times of the secondary electrons between the first dynode DY1 and the second dynode DY2 is reduced. The secondary electron emitting surface is formed on an electron arrival surface of the first dynode DY1, and in response to the incidence of photoelectrons, secondary electrons are emitted from the first dynode DY1. The secondary electrons emitted from the first dynode DY1 propagate toward the second dynode DY2, which is set to a higher potential than the first dynode DY1. The second dynode DY2 is separated into two electron multiplier channels by the partitioning plate 332 that extends from the focusing electrode unit 300, and a structure is realized with which, crosstalk between the adjacent electron multiplier channels is suppressed by adjustment of the trajectories of the secondary electrons from the first dynode DY1. The secondary electron emitting surface is also formed on an electron arrival surface of the second dynode DY2, and the secondary electrons emitted from the secondary electron emitting surface of the second dynode DY2 propagate toward the third dynode DY3, which is set to a higher potential than the second dynode DY2. The secondary electrons emitted from the secondary electron emitting surface of the third dynode DY3 are likewise cascade-multiplied as the electrons proceed in the order of the fourth dynode DY4, the fifth dynode DY5, and the sixth dynode DY6. The sixth dynode DY6 is constituted by the two electrodes that constitute portions of the gain control unit 430*a* and by suitable adjustment of the set potentials of these two electrodes, the gains of the adjacent electron multiplier channels can be adjusted independent of each other. The secondary electrons emitted from the secondary electron emitting surfaces of the respective electrodes constituting the sixth dynode DY6 arrive at the seventh dynode DY7, and secondary electrons are emitted from the secondary electron emitting surface of the seventh dynode DY7 toward the anode 432 with mesh openings. The eighth dynode DY8 is set to a lower potential than the anode 432 and functions as an inverting dynode that emits secondary electrons, which have passed through the anode 432, back to the anode 432. The other electrode set, to which the gain control unit 430*b* belongs, also functions in the same manner.

Next, the structural feature of the photomultiplier according to the present invention will be explained. This structural feature concerns the shape of the faceplate 110 that constitutes a portion of the sealed container 100. Specifically, a peripheral region of the light emission surface 110*b* (surface positioned in the internal space of the sealed container 100) of the faceplate 110, on which the photocathode 200 is formed, is rounded (processed to a curved surface with a predetermined radius of curvature) so as to protrude gradually toward the anode 432 side with distance from the tube axis AX.

Figure 7A:
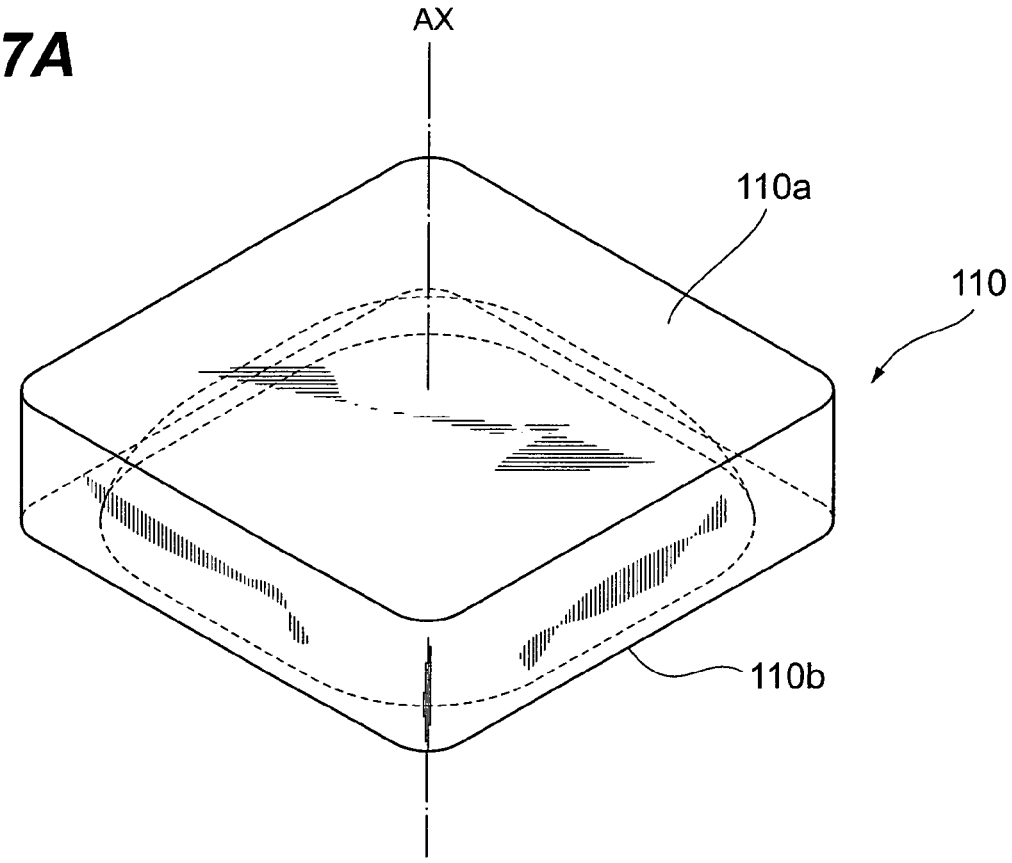
FIGS. 7A and 7B are perspective views for explaining a representative shape of a faceplate that constitutes a portion of the sealed container in the photomultiplier according to the present invention.
Figure 7B:
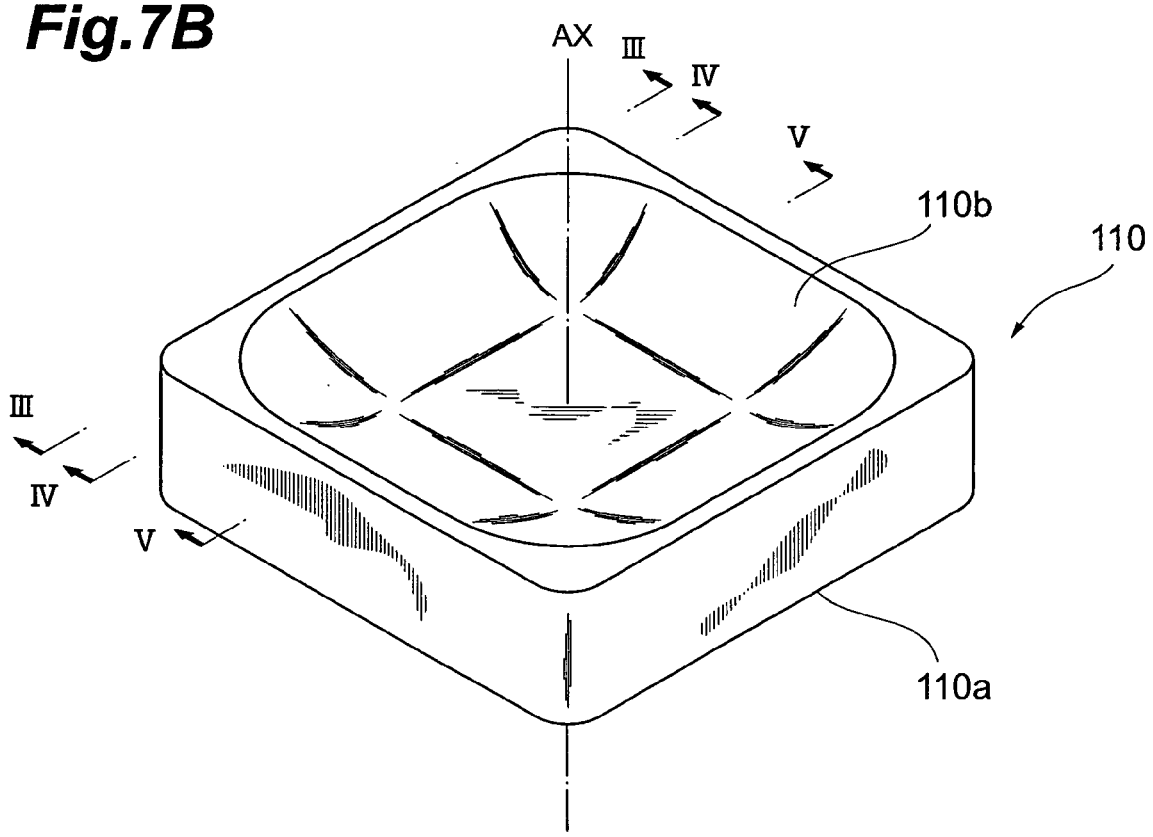
Figure 8A:
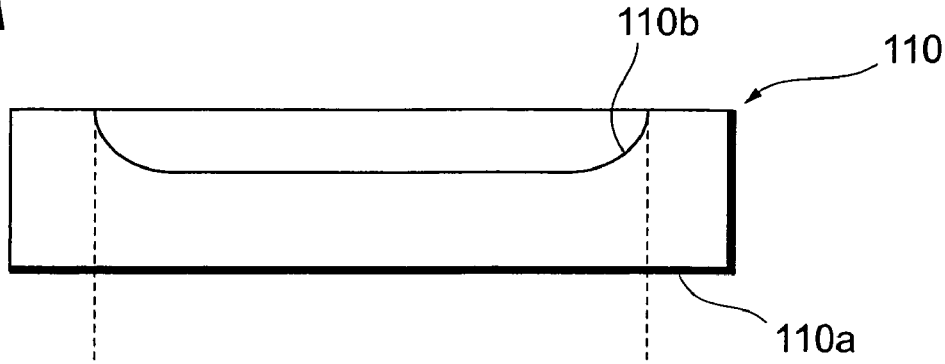
FIGS. 8A to 8C are cross sectional views of the faceplate respectively taken on line III-III, line IV-IV, and line V-V in FIG. 7B.
Figure 8B:
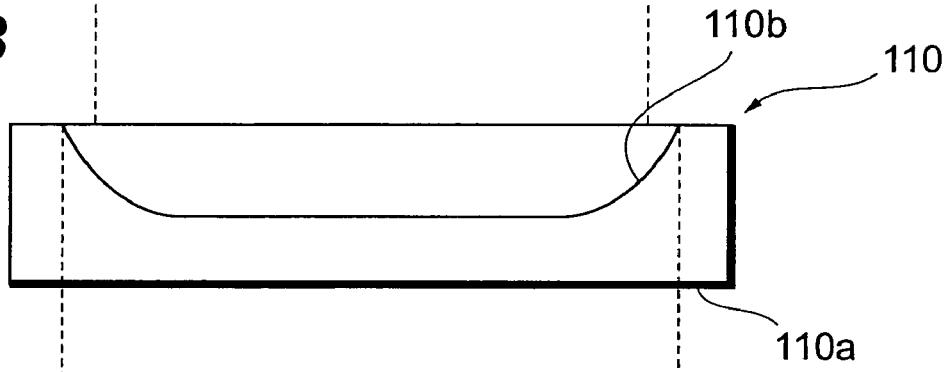
Figure 8C:
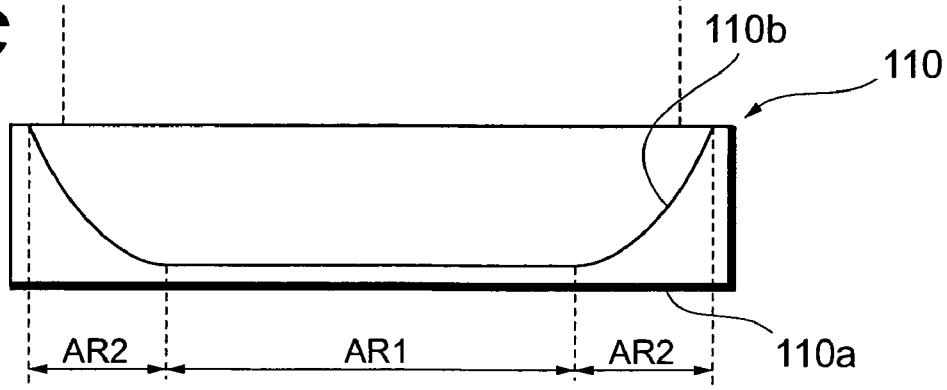

FIGS. 7A and 7B are perspective views for explaining a representative shape of the faceplate 110 that constitutes a portion of the sealed container 100 in the photomultiplier according to the present invention. In particular, FIG. 7A is a perspective view of the faceplate 110 as viewed from the light incidence surface 110*a* side, and FIG. 7B is a perspective view of the faceplate 110 as viewed from the light emission surface 110*b* side, at which the photocathode 200 is formed. FIG. 8A is a cross sectional view of the faceplate 110 taken on line III-III in FIG. 7B. FIG. 8B is a cross sectional view of the faceplate taken on line IV-IV in FIG. 7B. FIG. 8C is a cross sectional view of the faceplate taken on line V-V in FIG. 7B.

As can be understood from the perspective view of FIG. 7B and the cross sectional views of FIGS. 8A to 8C, the light emission surface 110*b* of the faceplate 110 on which the photocathode 200 is formed is constituted by a central region AR1 (a flat region of the light emission surface 110*b*, which is substantially parallel to the light incidence surface 110*a* and in which the thickness of the faceplate 110 is constant) that contains the tube axis AX, and a peripheral region AR2 that surrounds the central region AR1 and includes boundary portions (edges of the light emission surface 110*b*), at which the light emission surface 110*b* and the inner wall of the tube body 120 intersect. The peripheral region AR2 is the curved-surface processed region that has been rounded so as to be curved at a predetermined radius of curvature in cross sections of the faceplate 110.

Figure 9A:
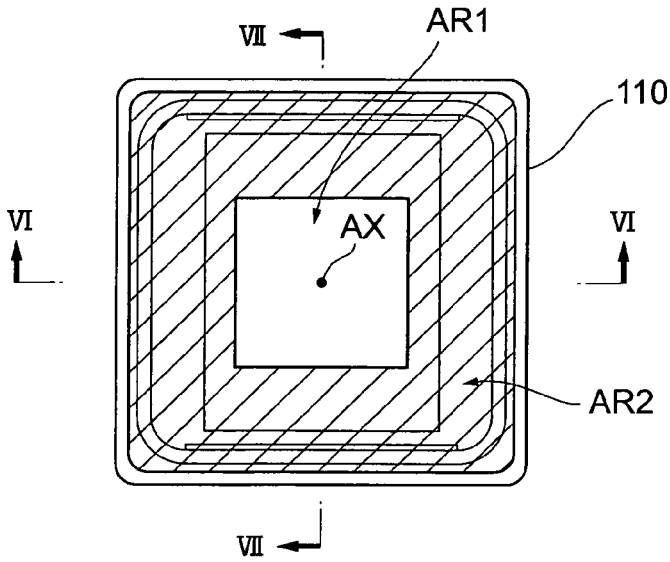
FIGS. 9A to 9C are diagrams for explaining trajectories of photoelectrons emitted from a photocathode in order to explain a structural feature and effects thereof of the photomultiplier according to the present invention.
Figure 9B:
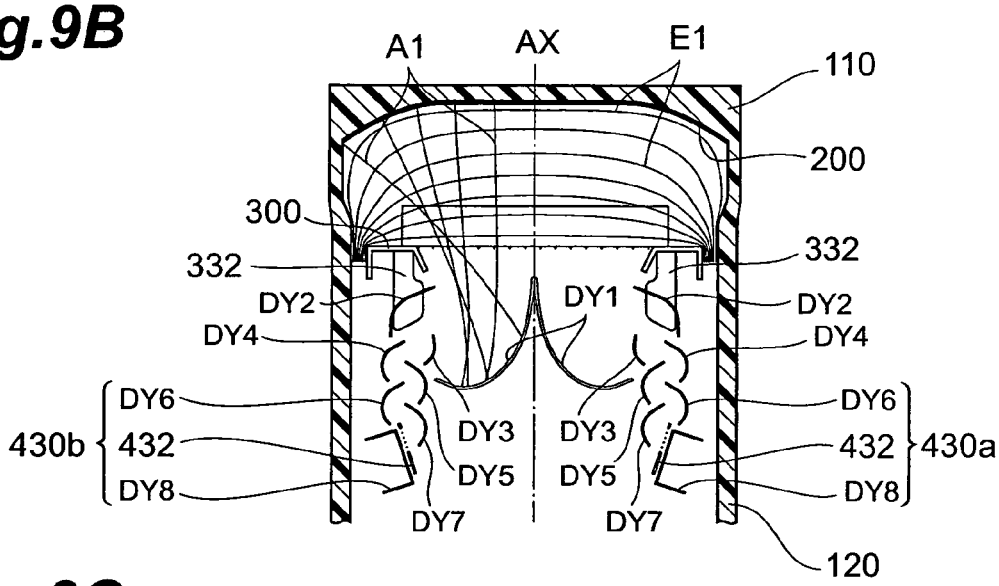
Figure 9C:
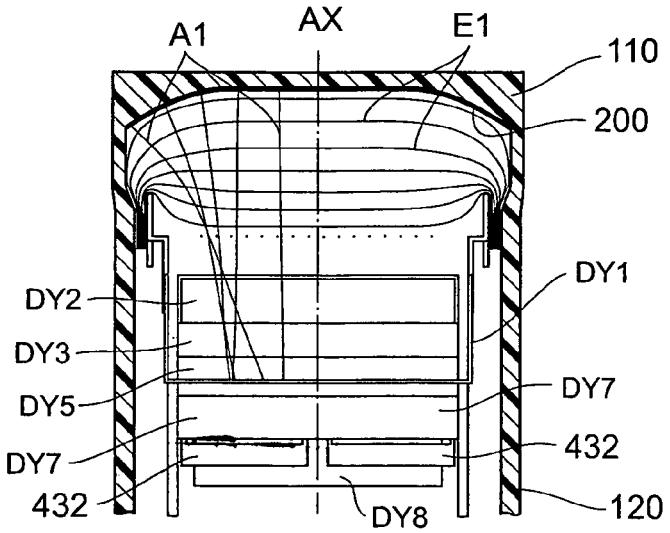
Figure 10A:
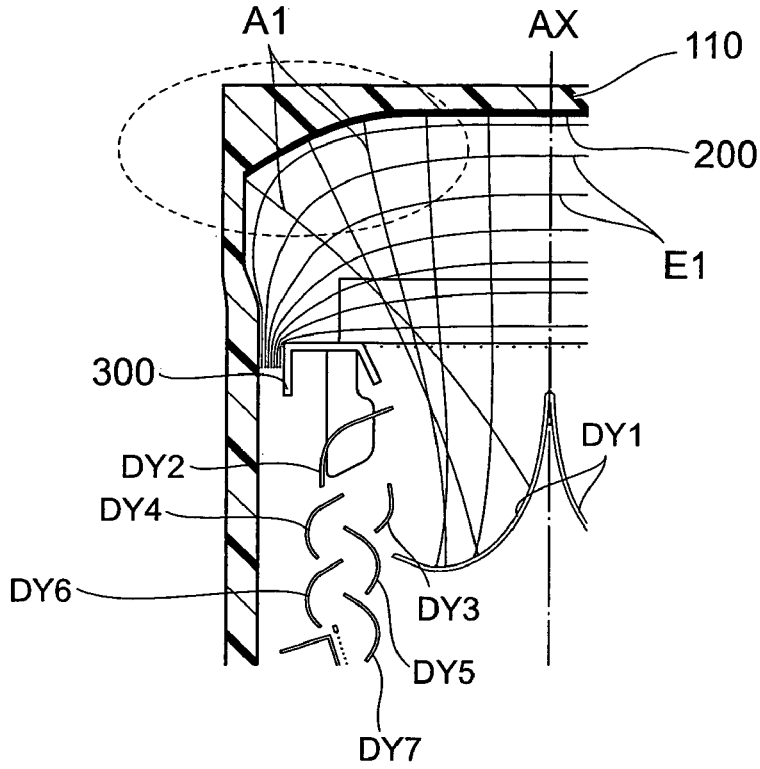
FIGS. 10A and 10B are enlarged views of principal portions of FIGS. 9B and 9C, respectively.
Figure 10B:
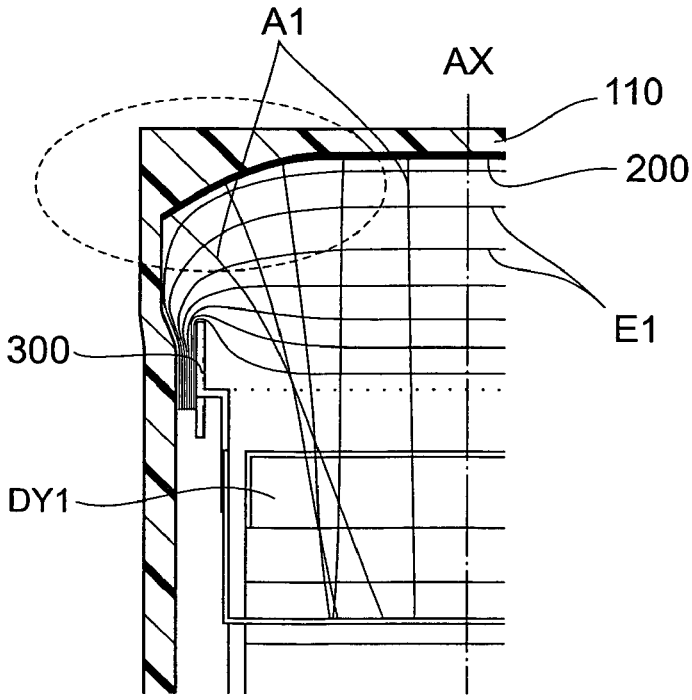
Figure 11A:
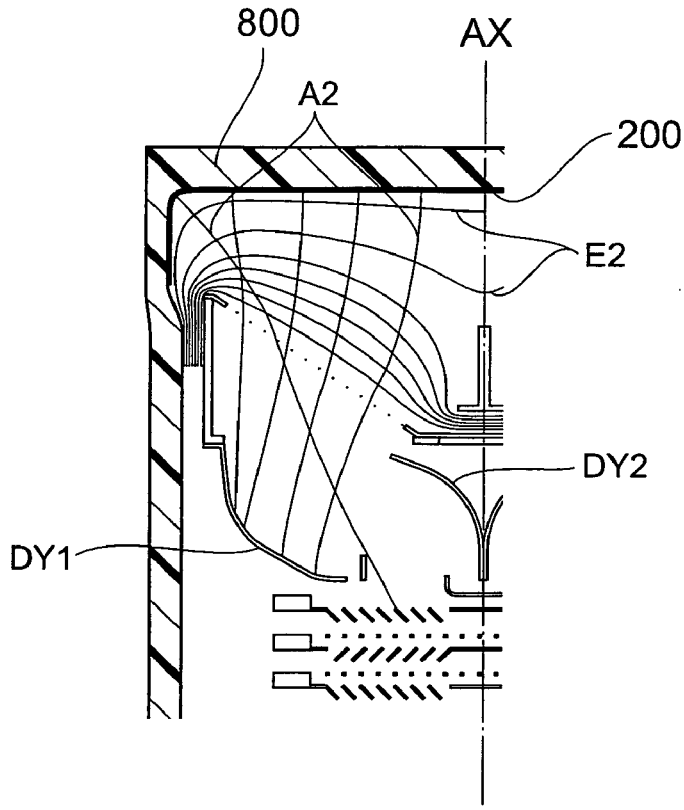
FIGS. 11A and 11B are cross sectional views, corresponding to FIGS. 10A and 10B, of a photomultiplier according to a comparative example prepared for explaining the effects of the structural feature of the photomultiplier according to the present invention, and are diagrams for explaining trajectories of photoelectrons in the photomultiplier according to the comparative example.
Figure 11B:
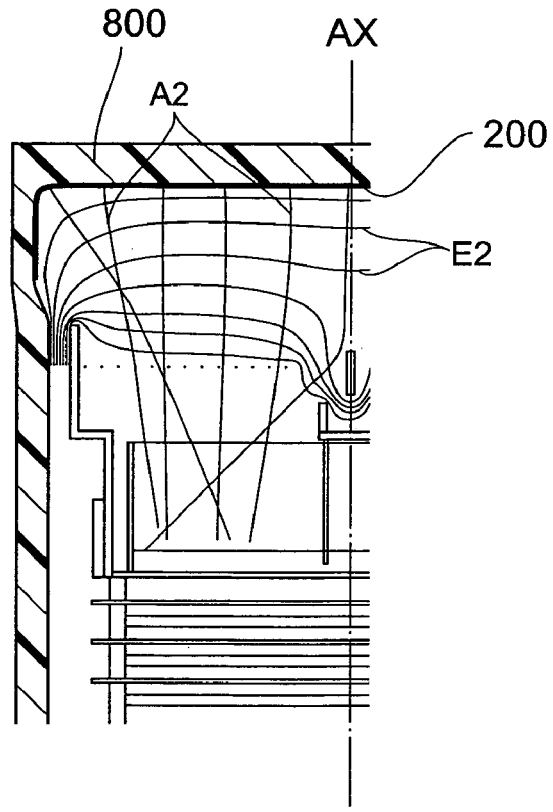

Subsequently, effects of the structural feature shall now be explaining in detail using FIGS. 9A to 11B. FIGS. 9A to 9C are diagrams for explaining trajectories A1 of photoelectrons emitted from the photocathode 200 in order to explain the structural feature and effects thereof of the photomultiplier according to the present invention. FIG. 9A is a plan view of the faceplate 110 as viewed from the light incidence surface 110*a* side, and an effective cathode area (that practically coincides with the light emission surface 110*b* of the faceplate 110) is constituted by the flat region AR1 and the curved-surface processed region AR2. The flat region AR1 is the region positioned at a middle that includes the tube axis AX and is the central region in which the thickness of the faceplate 110 is constant. The curved-surface processed region AR2 is positioned at the periphery of the flat region AR1 so as to surround the flat region AR1 and is arranged as the curved-surface processed region AR2 that includes the edges of the light emission surface 110*b*. FIG. 9B is a cross sectional view of the photomultiplier taken on line VI-VI shown in FIG. 9A, and FIG. 9C is a cross sectional view of the photomultiplier taken on line VII-VII shown in FIG. 9A. FIGS. 10A and 10B are enlarged views of principal portions of FIGS. 9B and 9C, respectively. FIGS. 11A and 11B are cross sectional views, corresponding to FIGS. 10A and 10B, of a photomultiplier according to a comparative example prepared for explaining the effects of the structural feature of the photomultiplier according to the present invention, and are diagrams for explaining trajectories of photoelectrons in the photomultiplier according to the comparative example. In each of FIGS. 9B to 10B, A1 shows a trajectory of photoelectron and E1 shows an equipotential. Furthermore, in each of FIGS. 11 A and 11B, A2 shows a trajectory of photoelectron and E2 shows an equipotential.

As can be understood from FIG. 9B (FIG. 10A) and FIG. 9C (FIG. 10B), near the curved-surface processed region AR1, a strong electric field strength is obtained and the intervals of equipotential lines E1 in the space between the photocathode 200 and the focusing electrode unit 300 of the electron multiplier section 500 are uniform. The trajectories A1 of the photoelectrons emitted from the photocathode 200 are thus of substantially equal length and do not depend on the emission position. The transit distances of photoelectrons emitted from and near the curved-surface processed region AR2 and the transit distances of the photoelectrons emitted near the tube axis AX are thus substantially equal and the TTS within a single electron multiplier channel is thus improved dramatically.

On the other hand, as shown in FIGS. 11A and 11B, in the electron multiplier according to the comparative example, a light emission surface (surface on which the photocathode 200 is formed) of a faceplate 800 does not have a curved-surface processed region provided at a peripheral region that includes edges of the light emission surface. The intervals of equipotential lines E2 in the space between the periphery of the photocathode 200 and an electron multiplier section are thus not controlled to be uniform. Trajectories A2 of photoelectrons emitted from the photocathode 200 thus depend on the emission position and differ greatly in length. Also, a portion of the photoelectrons emitted from the photocathode 200 arrive directly at the second dynode DY2 without arriving at the first dynode DY1. Thus, with the photomultiplier according to the comparative example that does not have a curved-surface processed region provided at a region corresponding to the periphery of the photocathode 200, the transit distances of photoelectrons emitted from the periphery of the photocathode 200 and the transit distances of photoelectrons emitted from near the tube axis AX differ significantly, and improvement of the TTS within a single electron multiplier channel cannot be anticipated.

Figure 12:
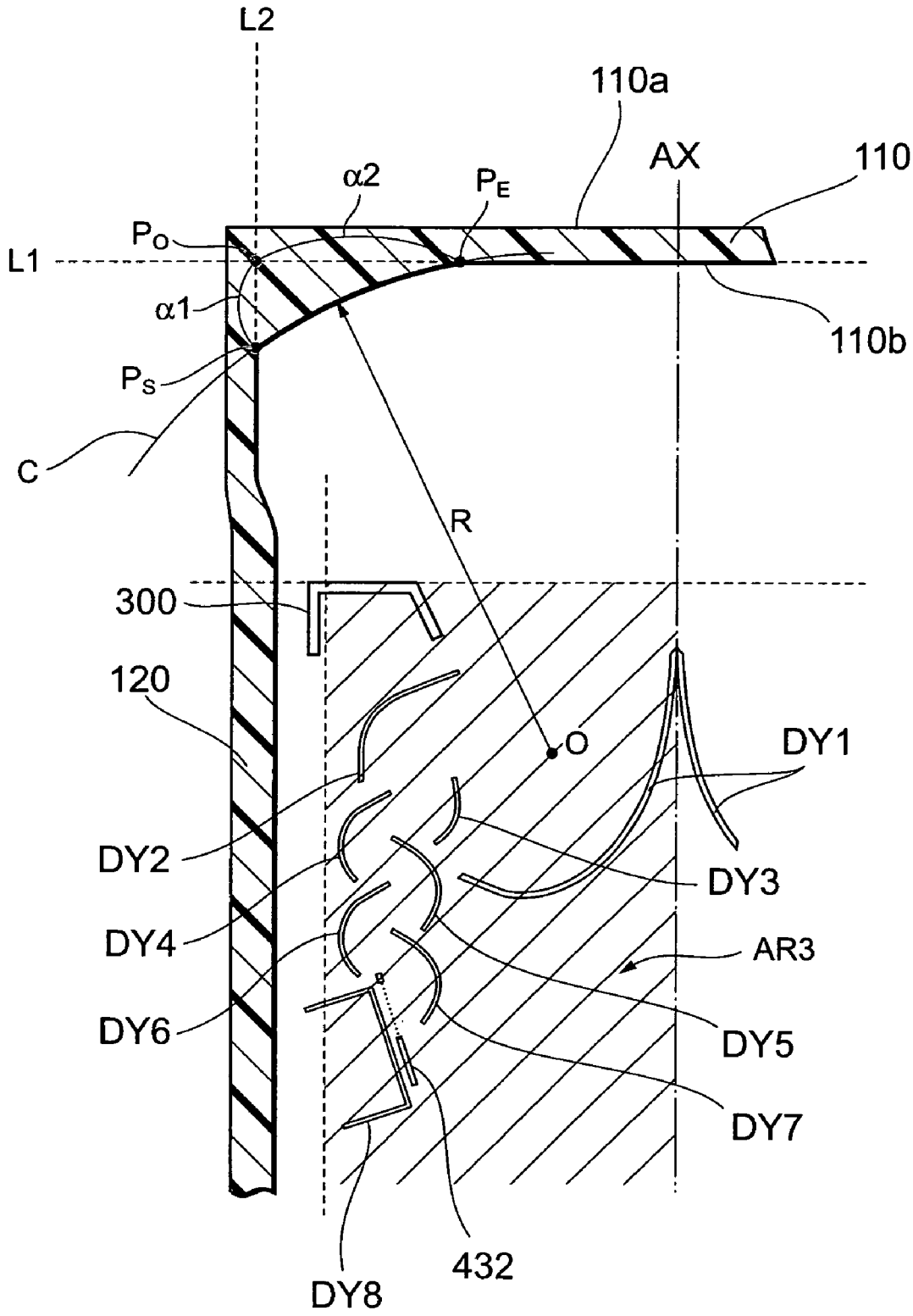
FIG. 12 is a cross sectional view of a principal portion of the photomultiplier according to the present invention in order to explain the structural feature of the photomultiplier.
Figure 13A:
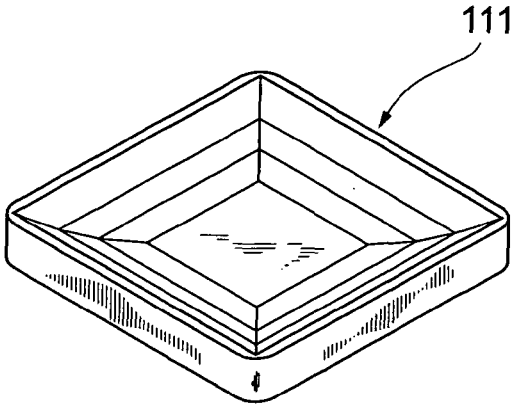
FIGS. 13A to 13E are perspective views of modified examples of the faceplate in the photomultiplier according to the present invention.
Figure 13B:
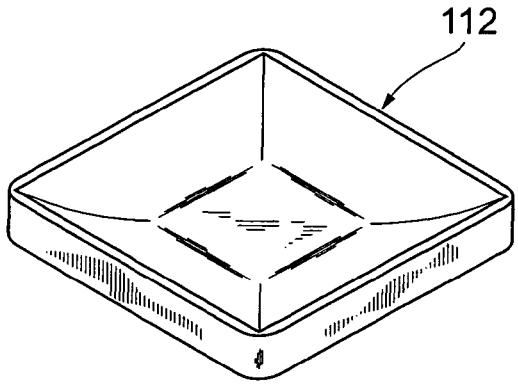
Figure 13C:
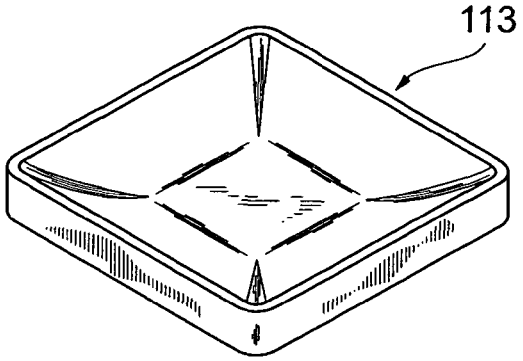
Figure 13D:
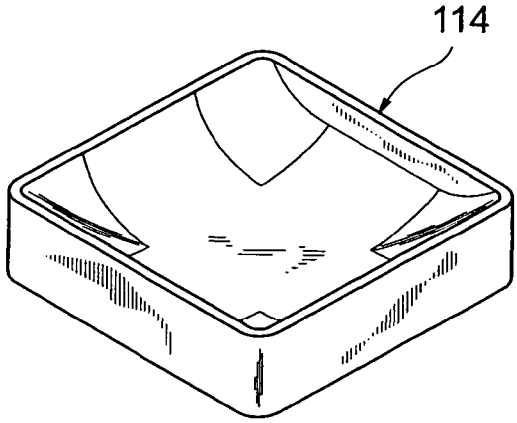
Figure 13E:
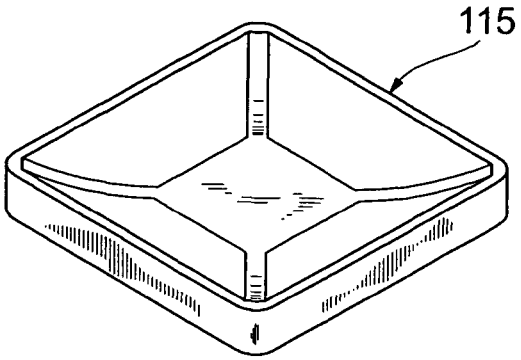
Figure 14A:
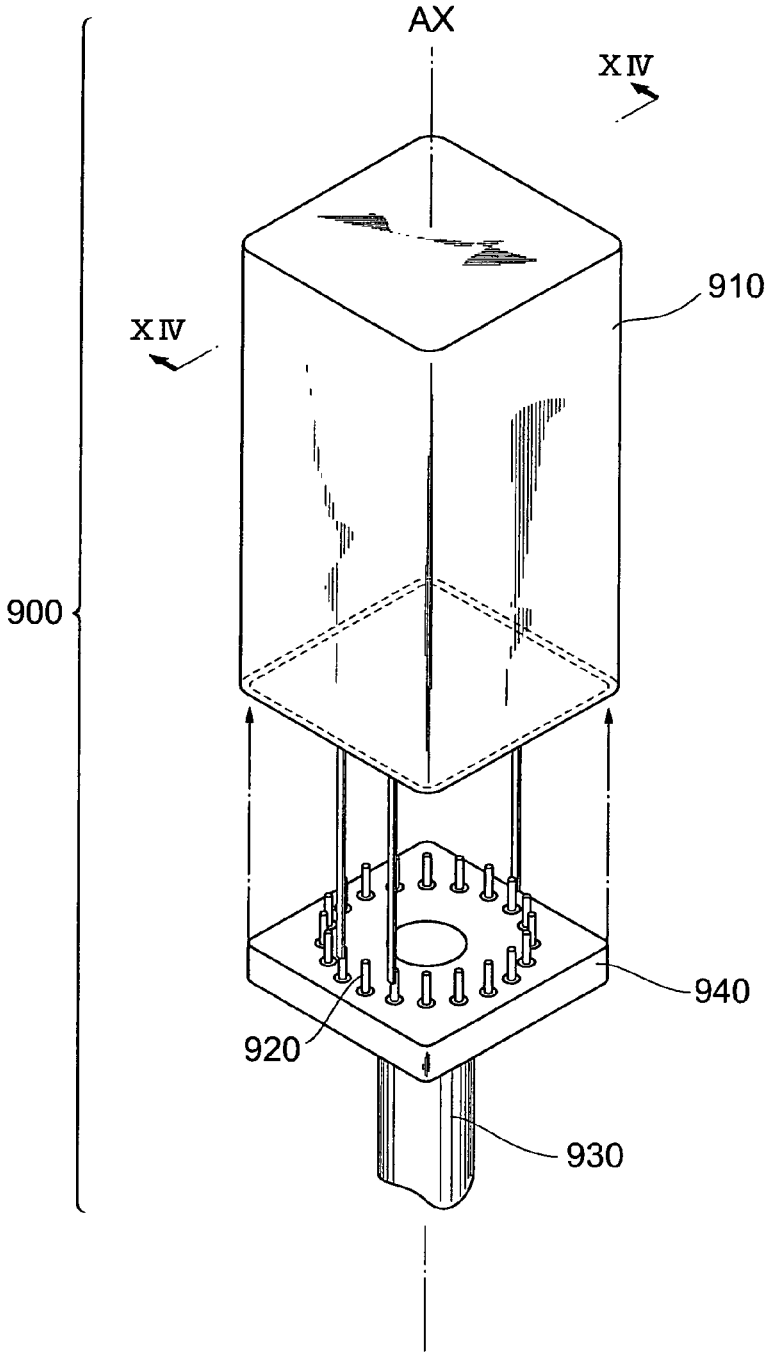
FIGS. 14A and 14B are an assembly process diagram and a cross sectional view, respectively, for explaining another structure of the sealed container in the photomultiplier according to the present invention.
Figure 14B:
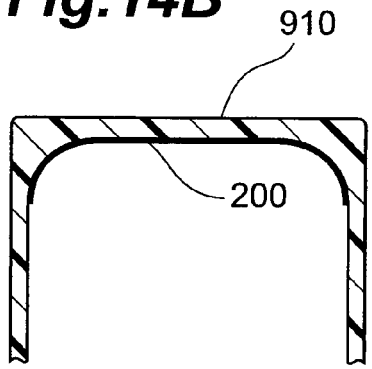

FIG. 12 is a cross sectional view of a principal portion of the photomultiplier according to the present invention in order to explain the structural feature of the photomultiplier. The cross section shown in FIG. 12 is a surface that includes the tube axis AX and cuts across the two electrode sets (dynode sets) that are positioned so as to sandwich the tube axis AX.

In the cross section shown in FIG. 12, a curve that defines the curved-surface processed region AR2 is positioned at the electron multiplier section side of an intersection $P_o$ of a straight line L1 on the flat region AR1 of the light emission surface 110*b*, which is parallel to the light incidence surface 110*a* of the faceplate 110, and a straight line L2 that is parallel to the inner wall surface of the tube body 120 and passes through an edge of the light emission surface 110*b*.

Also, in the cross section shown in FIG. 12, $P_E$ is an intersection of the straight line L1 and the curve defining the curved-surface processed region AR1 and this intersection $P_E$ corresponds to being a boundary of the flat region AR1 and the curved-surface processed region AR2. $P_S$ is an intersection of the straight line L2 and the curve defining the curved-surface processed region AR1 and this intersection $P_S$ corresponds to being an edge of the effective cathode area. Here, the distance $\alpha_1$ between the intersection $P_o$ and the intersection $P_S$ is made less than the distance $\alpha_2$ between the intersection $P_o$ and the intersection $P_E$.

In the cross section shown in FIG. 12, a central point O of a curvature radius R that defines a curve C corresponding to the curved-surface processed region AR2 is located inside a region AR3. Specifically, the central point O of the curvature radius R that defines the curve C on the curved-surface processed region AR2 is positioned at the inner wall surface side of the tube body 120 with respect to the tube axis AX and is positioned more towards the anode 432 side than the focusing electrode unit 300.

Based on the measurement results shown in FIGS. 9A to 11B, the area ratio of the flat region AR1 with respect to the effective cathode area (including the flat region AR1 and the curved-surface processed region AR2) in the light emission surface 110*b* of the light incidence plate 110 on which the photocathode 200 is formed is preferably 30% or more but 70% or less.

The boundary between the flat region AR1 and the curved-surface processed region AR2 on the light emission surface 110*b* of the faceplate 110 can be specified approximately by using a laser light measurement system. Specifically, by disposing a laser displacement meter at the light incidence surface 110*a* side of the faceplate 110 and observing the laser light, among the laser light transmitted through the light incidence surface 110*a*, that is reflected by the light emission surface 110*b*, the surface shape of the light emission surface 110*b* can be measured. Here, because the laser light that reaches the curved-surface processed region AR2 of the light emission surface 110*b* does not return correctly to the laser displacement meter, shape measurement cannot be performed for this region. On the other hand, because the laser light that arrives at the flat region AR1 returns to the laser displacement meter correctly, the region in the light emission surface 110*b* with which the shape can be measured can be specified as the flat region AR1.

Shape measurement of the light emission surface 110*b* was carried out by using a measurement system constituted by a laser displacement meter LK-010 (sensor head), made by Keyence Corp., a CCD laser displacement sensor LK-3100 (amp unit), made by Keyence Corp., a two-dimensional shape measurement system ADS 2000 BS-200X-ADS (X-axis stage with built-in rotary encoder), made by COMS Co., Ltd., a digital counter CT-02, and an analog data collection device BOXCA-01. In accordance with this measurement system, the flat region AR1 was confirmed to have an unevenness of approximately 0.12 mm. Because the present embodiment is characterized in that the shape of the peripheral region of the photocathode 200 is changed as suited by processing the surface shape of the light emission surface 110*b*, on which the photocathode 200 is formed, to a special shape (for the purpose of controlling the trajectories of photoelectrons emitted from the photocathode 200), an unevenness of this degree in the flat region AR1 can be tolerated adequately.

FIGS. 13A to 13E are perspective views of modified examples of the faceplate 110 in the photomultiplier according to the present invention. In a faceplate 111 shown in FIG. 13A, a curved-surface processed region of a light emission surface, on which the photocathode 200 is formed, is formed by arranging a periphery of the light emission surface from a plurality of flat surface elements. The curved surface region can thus be formed approximately from a plurality of flat surfaces. By increasing the number of flat surface elements that form the curved-surface processed region, a curved surface can be approximated more closely. In a faceplate 112 shown in FIG. 13B, a periphery of a light emission surface is rounded parallel to respective sides of the faceplate 112, and boundaries of these curved-surface processed regions are straight lines. The same effect as the above-described faceplate 110 can be obtained by this faceplate 112 as well. In a faceplate 113 shown in FIG. 13C, a rounding process of a predetermined curvature radius is applied further to the boundaries of the rounded surfaces of the faceplate 112 shown in FIG. 13B, thus providing practically the same shape as that of the faceplate 110 shown in FIGS. 7A to 8C. In a faceplate 114 shown in FIG. 13D, rounding is performed on a pair of opposing sides of the faceplate 114. Particularly, in the case where electron multiplication is to be performed by only two channels in an electron multiplier section housed inside the sealed container 100, the faceplate does not have to be rounded in all directions, and rounding of just a pair of sides is sufficient. In a faceplate 115 shown in FIG. 13E, though a periphery of a light emission surface is rounded in parallel to the respective sides of the faceplate 115 as in the faceplate 112 shown in FIG. 13B, the curved-surface processed regions are separated by a predetermined distance at the four corners of the faceplate 115. The same effects as those of the above-described faceplate 110 can be anticipated with the faceplate 115 of such a shape as well.

In the above-described embodiment, the sealed container 100 of the photomultiplier according to the present invention is constituted by the faceplate 110, the tube body 120, and the stem 130. However, the sealed container applied to the photomultiplier is not restricted to the above-described structure. That is, as shown in FIG. 21A, a sealed container may be constituted by an envelope portion 910, with which a faceplate and a tube body are formed integrally, and a stem 940, which holds an evacuating pipe 930 and lead pins 920. FIG. 21B is a cross sectional view of a structure of the other sealed container taken on line XIV-XIV shown in FIG. 21A and particularly shows a structure near the faceplate, on the inner side of which is formed the photocathode 200. Even in such a sealed container, by a curved-surface processed region being formed at a peripheral region of a light emission surface of the faceplate on which the photocathode 200 is formed, the effects of the above-described photomultiplier can be provided.

As described above, in accordance with the photomultiplier according to the present invention, the TTS, CTTD, and other response time properties are improved significantly. Also, by the gain control unit, with which a portion of the dynodes and the anode are integrated, the number of parts in the assembly process can be reduced and a plurality of electron multiplier channels can be arranged with a simpler structure.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A photomultiplier comprising a sealed container which includes: a hollow body section extending along a predetermined tube axis; and a faceplate, for transmitting light with a predetermined wavelength, arranged so as to intersect the tube axis, said sealed container accommodating, in its interior, a photocathode, an electron multiplier section which includes at least one set of secondary electron emitting electrodes, and an anode, wherein said faceplate has: a light incidence surface at which the light with the predetermined wavelength arrives; and a light emission surface which opposes said light incidence surface and on which said photocathode is formed, said light emission surface being constituted by: a flat region positioned at a middle of said light emission surface which includes the tube axis; and a curved-surface processed region positioned at a periphery of said flat region which includes edges of said light emission surface, and wherein, in a cross section of said photomultiplier which includes the tube axis and that crosses at least said one set of electrodes, a curve that defines said curved-surface processed region is positioned at the electron multiplier section side, with reference to an intersection of a first straight line on said flat region and a second straight line that is parallel to an inner wall surface of said hollow body section and passes through an edge of said light emission surface.

2. A photomultiplier comprising a sealed container which includes: a hollow body section extending along a predetermined tube axis; and a faceplate, for transmitting light with a predetermined wavelength, arranged so as to intersect the tube axis, said sealed container accommodating, in its interior, a photocathode, an electron multiplier section which includes at least one set of secondary electron emitting electrodes, and an anode, wherein said faceplate has: a light incidence surface at which the light with the predetermined wavelength arrives; and a light emission surface which opposes said light incidence surface and on which said photocathode is formed, said light emission surface being constituted by: a flat region positioned at a middle of said light emission surface which includes the tube axis; and a curved-surface processed region positioned at a periphery of said flat region which includes edges of said light emission surface, and wherein, in a cross section of said photomultiplier that includes the tube axis and that crosses at least said one set of electrodes, when $P_E$ is an intersection of a first straight line on said flat region and a curve that defines said curved-surface processed region, $P_S$ is an intersection of a second straight line that is parallel to an inner wall surface of said hollow body section and that passes through an edge of said light emission surface and a curve that defines said curved-surface processed region, a distance $\alpha_1$ between an intersection $P_o$ of the first and second straight lines and the intersection $P_S$ is shorter than a distance $\alpha_2$ between the intersection $P_o$ and the intersection $P_E$.

3. A photomultiplier comprising a sealed container which includes: a hollow body section extending along a predetermined tube axis; and a faceplate, for transmitting light with a predetermined wavelength, arranged so as to intersect the tube axis, said sealed container accommodating, in its interior, a photocathode, an electron multiplier section which includes at least one set of secondary electron emitting electrodes, a focusing electrode arranged between said photocathode and said electron multiplier section, and an anode, wherein said faceplate has: a light incidence surface at which the light with the predetermined wavelength arrives; and a light emission surface which opposes said light incidence surface and on which said photocathode is formed, said light emission surface being constituted by: a flat region positioned at a middle of said light emission surface which includes the tube axis; and a curved-surface processed region positioned at a periphery of said flat region which includes edges of said light emission surface, and wherein, in a cross section of said photomultiplier that includes the tube axis and that crosses across at least said one set of electrodes, a central point of a radius of curvature that defines a curve corresponding to said curved-surface processed region is positioned closer to an inner wall surface of said hollow body section than the tube axis and closer to said anode than said focusing electrode.

4. A photomultiplier comprising a sealed container which includes: a hollow body section extending along a predetermined tube axis; and a faceplate, for transmitting light with a predetermined wavelength, arranged so as to intersect the tube axis, said sealed container accommodating, in its interior, a photocathode, an electron multiplier section, a focusing electrode arranged between said photocathode and said electron multiplier section, and an anode, wherein said faceplate has: a light incidence surface at which the light with the predetermined wavelength arrives; and a light emission surface which opposes said light incidence surface and on which said photocathode is formed, said light emission surface being constituted by: a flat region positioned at a middle of said light emission surface which includes the tube axis; and a curved-surface processed region positioned at a periphery of said flat region which includes edges of said light emission surface, and wherein, in said light emission surface of said faceplate, an area ratio of said flat region with respect to an effective cathode area that includes said flat region and said curved-surface processed region is 30% or more but 70% or less.

5. A photomultiplier according to claim 1, wherein said electron multiplier section includes, as one of said electron emitting electrodes, a first dynode that receives photoelectrons emitted from said photocathode and emits secondary electrons in response to the incidence of the photoelectrons, and said first dynode is arranged such that at least a part of a secondary electron emitting surface of said first dynode directly faces said flat region that is surrounded by said curved-surface processed region.

6. A photomultiplier according to claim 5, wherein said electron multiplier further includes, as one of said electron emitting electrodes, a second dynode that receives the secondary electrons emitted from said first dynode, and said second dynode is arranged such that a part of said second dynode crosses the straight line that passes through said curved-surface processed region and is parallel to the tube axis.

7. A photomultiplier according to claim 2, wherein said electron multiplier section includes, as one of said electron emitting electrodes, a first dynode that receives photoelectrons emitted from said photocathode and emits secondary electrons in response to the incidence of the photoelectrons, and said first dynode is arranged such that at least a part of a secondary electron emitting surface of said first dynode directly faces said flat region that is surrounded by said curved-surface processed region.

8. A photomultiplier according to claim 7, wherein said electron multiplier further includes, as one of said electron emitting electrodes, a second dynode that receives the secondary electrons emitted from said first dynode, and said second dynode is arranged such that a part of said second dynode crosses the straight line that passes through said curved-surface processed region and is parallel to the tube axis.

9. A photomultiplier according to claim 3, wherein said electron multiplier section includes, as one of said electron emitting electrodes, a first dynode that receives photoelectrons emitted from said photocathode and emits secondary electrons in response to the incidence of the photoelectrons, and said first dynode is arranged such that at least a part of a secondary electron emitting surface of said first dynode directly faces said flat region that is surrounded by said curved-surface processed region.

10. A photomultiplier according to claim 9, wherein said electron multiplier further includes, as one of said electron emitting electrodes, a second dynode that receives the secondary electrons emitted from said first dynode, and said second dynode is arranged such that a part of said second dynode crosses the straight line that passes through said curved-surface processed region and is parallel to the tube axis.

11. A photomultiplier according to claim 4, wherein said electron multiplier section includes, as one of said electron emitting electrodes, a first dynode that receives photoelectrons emitted from said photocathode and emits secondary electrons in response to the incidence of the photoelectrons, and said first dynode is arranged such that at least a part of a secondary electron emitting surface of said first dynode directly faces said flat region that is surrounded by said curved-surface processed region.

12. A photomultiplier according to claim 11, wherein said electron multiplier further includes, as one of said electron emitting electrodes, a second dynode that receives the secondary electrons emitted from said first dynode, and said second dynode is arranged such that a part of said second dynode crosses the straight line that passes through said curved-surface processed region and is parallel to the tube axis.

* * * * *